US006167702B1

(12) United States Patent
Schniederjan

(10) Patent No.: US 6,167,702 B1
(45) Date of Patent: Jan. 2, 2001

(54) ROTARY MECHANISM CONTROL WITH POWER SUPPLY

(75) Inventor: Reinhold Schniederjan, Neu-Ulm (DE)

(73) Assignee: Brueninghaus Hydromatik GmbH, Elchingen (DE)

( * ) Notice: Under 35 U.S.C. 154(b), the term of this patent shall be extended for 0 days.

(21) Appl. No.: 09/117,851

(22) PCT Filed: Apr. 17, 1997

(86) PCT No.: PCT/EP97/01920

§ 371 Date: Aug. 12, 1998

§ 102(e) Date: Aug. 12, 1998

(87) PCT Pub. No.: WO97/44535

PCT Pub. Date: Nov. 27, 1997

(30) Foreign Application Priority Data

May 22, 1996 (DE) ..... 196 20 665

(51) Int. Cl.[7] ..... F16D 31/02
(52) U.S. Cl. ..... 60/444
(58) Field of Search ..... 60/444

(56) References Cited

U.S. PATENT DOCUMENTS 4,075,841 * 2/1978 Hamma et al. ..... 60/444
4,571,940 * 2/1986 Wuchenauer ..... 60/444

FOREIGN PATENT DOCUMENTS 4001 888 A1 8/1990 (DE) .
44 05 472 A1 8/1995 (DE) .
0 056 865 8/1982 (EP) .
0 057 930 8/1982 (EP) .

* cited by examiner

*Primary Examiner*—F. Daniel Lopez
(74) *Attorney, Agent, or Firm*—Scully, Scott, Murphy & Presser

(57) ABSTRACT

The invention relates to a hydraulic controller, in particular for the control of the rotating mechanism of an excavator. In a hydraulic drive circuit a drive hydraulic pump (2) and a drive hydraulic motor are provided, which are connected via working lines (3, 4). The hydraulic controller includes an adjustment arrangement (9) for adjusting a setting piston (12) arranged between two setting pressure chambers (10, 11) and acting upon the displacement volume of the drive hydraulic pump (2). Further, a pre-control arrangement (8) is provided which acts upon one of the setting pressure chambers (10, 11) with a setting pressure, in dependence upon the pressure difference between two control lines (6, 7). In accordance with the development according to the invention, the precontrol arrangement (8) is connected with a feed line (30) via a pressure regulation valve (56), whereby the precontrol arrangement (8), in a control position (42, 43), connects one of the two setting pressure chambers (10; 11) with the feed line (19) via the pressure regulation valve (56) and connects the respective other setting pressure chamber (11; 10) with a pressure fluid tank (17). In a neutral position (41), both setting pressure chambers (10, 11) are connected with the feed line (30) via the pressure regulation valve (56).

12 Claims, 3 Drawing Sheets

ROTARY MECHANISM CONTROL WITH POWER SUPPLY

BACKGROUND OF THE INVENTION

1. Field of the Invention

The invention relates to a hydraulic controller, in particular for the control of the rotating mechanism of an excavator.

2. Discussion of the Prior Art

A hydraulic controller in accordance with the State-of-the-technology is disclosed e.g. in DE 44 05 472 A1. The hydraulic circuit diagram of this known hydraulic controller is, for better understanding of the invention, reproduced in FIG. 2 of the drawings and will be briefly described below with reference to FIG. 2.

The known rotating mechanism controller 1, illustrated in FIG. 2, includes a drive hydraulic pump 2 which is connected via working lines 3, 4 with a drive hydraulic motor (not shown) for the drive of the rotating mechanism (likewise not shown) of an excavator. The hydraulic controller includes a hand controller 5 which is in connection with a pre-control arrangement 8 via control lines 6 and 7. By means of the pre-control arrangement 8, the necessary setting pressure is delivered to an adjustment arrangement 9, which setting pressure is obtained directly from the control pressure prevailing in the control lines 6, 7. The adjustment arrangement includes a setting piston 12, arranged between two setting pressure chambers 10 and 11, which setting piston acts upon the displacement volume of the working hydraulic pump 2.

Upon return of the hand controller 5 into its neutral position, the pre-control arrangement 8 likewise takes up its neutral position, so that the adjustment arrangement 9 is no longer supplied with hydraulic energy, i.e. with setting pressure. The working hydraulic pump 2 is slowly swung back to zero displacement volume via the return springs 13 and 14. Thereby, from an after-suction arrangement 74, which consists of the check valves 15 and the after-suction filter 16, pressure fluid is drawn into that setting pressure chamber 10 or 11 the volume of which increases in the return procedure.

This known rotating mechanism controller has, however, several grave disadvantages. Through the after-suction of pressure fluid out of the pressure fluid tank 17, particles of dirt can penetrate into the hydraulic controller. This problem can be only partially removed even by means of the after-suction filter 16. Since, during the after-suction procedure, only slight pressure differences prevail, the filter must be relatively large, which conflicts with the goal of a lesser constructional size of the hydraulic controller. Beyond this, the after-suction filter 16 must be regularly cleaned and serviced.

Insofar as particles of dirt penetrate into the pre-control arrangement 8 and lock this in one of its control positions, operational safety is put significantly at risk. The valve of the pre-control arrangement 8 is thereby not returned into its neutral position, but remains in one of its control positions. If, now, the respective other direction of rotation of the rotating mechanism is set by means of the hand controller 5, i.e. the respective other control line 6 or 7 is acted upon with control pressure, this does not lead to the intended reversal of the swing-out direction and thus the delivery direction of the working hydraulic pump 2. Rather, the working hydraulic pump 2 continues to deliver in its previously set delivery direction, so that the direction of rotation of the rotating mechanism is, contrary to the intentions of the user, not reversed, but the rotating mechanism is accelerated in the opposite direction. In practice, this can represent a significant source of danger.

A further disadvantage arises with the known rotating mechanism controller in that in control of the driving hydraulic pump it is not detected whether pressure fluid in sufficient quantity is available in the working lines 3 and 4. In this respect, problems can arise in particular in that the feed filter 18 of the feed arrangement 19 is blocked and the feed pump 20 cannot feed pressure fluid in sufficient quantity into the working circuit 3, 4. Thus, there is a danger of damage to the drive hydraulic pump 2 and to the drive hydraulic motor (not shown).

SUMMARY OF THE INVENTION

It is thus the object of the present invention to so further develop the known hydraulic controller that operational problems e.g. due to the penetration of dirt particles or the blocking of filters are avoided.

The invention is based upon the insight that by obtaining the setting pressure for the adjustment arrangement from the feed pressure made available by the feed arrangement, two goals are simultaneously attained. On the one hand it is ensured that after return of the hand controller and thus also of the pre-control arrangement into their respective neutral positions, filtered pressure fluid, for balancing the volume differences during the return procedure flows into the setting pressure chambers of the adjustment arrangement. An after-suction arrangement can be omitted. On the other hand, it is ensured that in case of a failure of the feed arrangement, e.g. through blockage of the feed filter, no setting pressure is available and thus the working hydraulic pump swings back into its neutral position. Thus, damage to the working hydraulic pump and the working hydraulic motor is reliably avoided in the case of this fault.

The pre-control arrangement can be constituted in per se known manner as a 4/3-way valve. However, it is more advantageous, corresponding to claim 3, to form the pre-control arrangement in a divided manner, with separate valve regions each respectively for one control pressure chamber of the adjustment arrangement. By these means, a separate control of the right and left slewing of the rotating mechanism is attained. Insofar as with this arrangement dirt particles might still penetrate into the valve of the pre-control arrangement and block this in one of its control position, it is ensured that upon change of the control direction by means of the hand controller and corresponding reversal of the pressure action on the control lines 6 and 7 no unintended acceleration of the rotating mechanism in the previously selected, opposite direction occurs. The pre-control arrangement can in this case be formed as a 6/3-way valve.

Corresponding to the invention, the pressure regulation valve provided between the feed arrangement and the pre-control arrangement, or—in the case of separate control of left and right slewing—the two pressure regulation valves provided, set the setting pressure to the control pressure prevailing in the control line or a slightly higher pressure. The pressure difference between the control pressure and the setting pressure can be attained by means of spring action on the pressure regulation valve or the pressure regulation valves.

Corresponding to the invention, a pressure cut-off valve may be provided between the control pressure lines and the pressure fluid tank, in order to limit the pressure in the control lines to a predetermined maximum pressure.

Further, corresponding to the invention, a brake valve may be provided, in order to make possible a slow, delayed breaking of the rotating mechanism.

BRIEF DESCRIPTION OF THE DRAWINGS

The invention will be described below in more detail with reference to two preferred exemplary embodiments and with reference to the drawings. In the drawings.

DETAILED DESCRIPTION OF PREFERRED EMBODIMENTS

Figure 1:
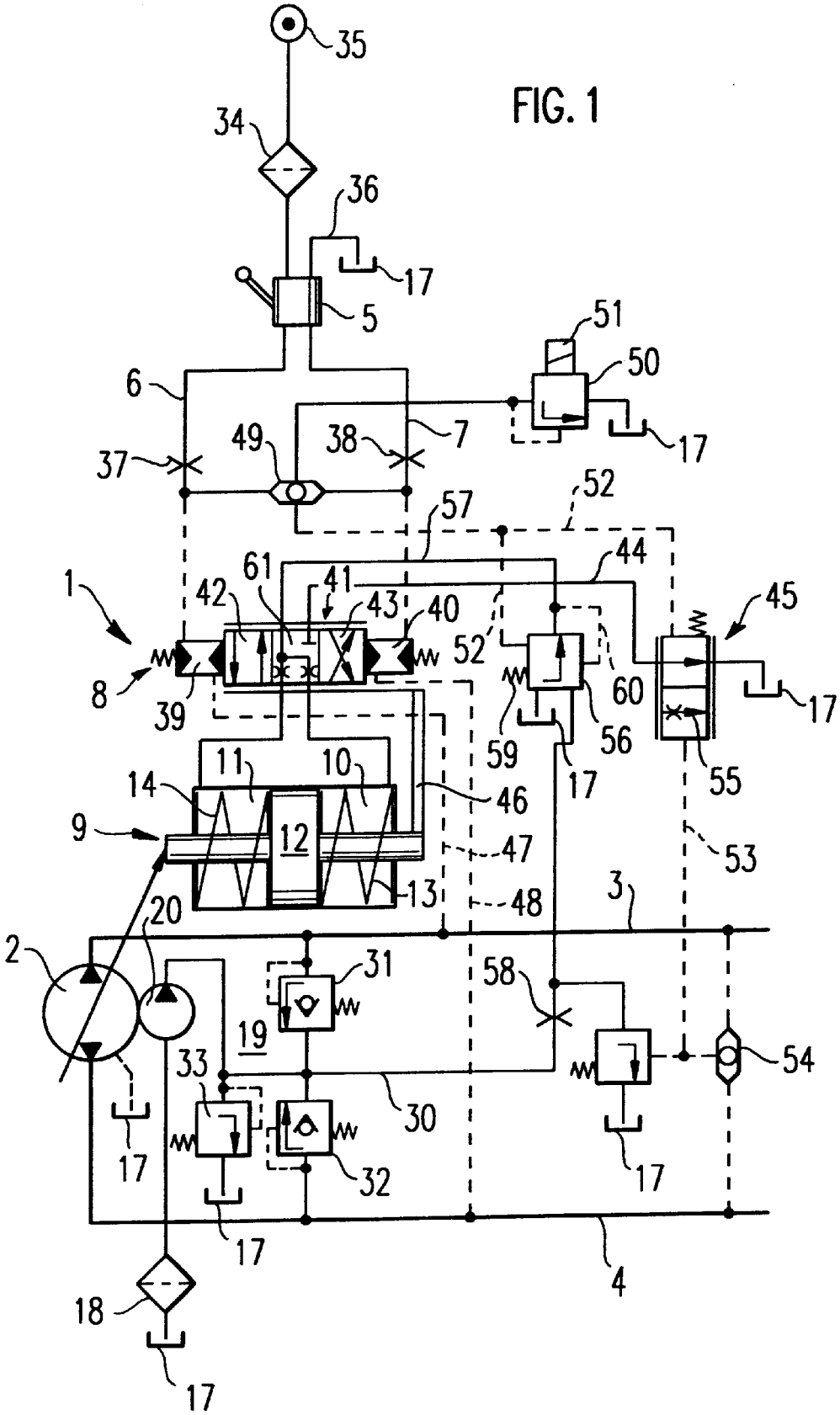
FIG. 1 shows a first exemplary embodiment of the hydraulic controller in accordance with the invention.

FIG. 1 shows a first exemplary embodiment of the hydraulic controller 1 in accordance with the invention.

The drive of the rotating mechanism is effected via a drive hydraulic motor (not shown) which is located in a hydraulic working circuit formed by means of the working lines 3 and 4, which circuit is supplied from the working hydraulic pump 2. The after-feed of leakage losses into the hydraulic circuit 3, 4 is effected by means of the feed arrangement 19 which includes a feed pump 20. The feed pump 20 is in the exemplary embodiment coupled to the working hydraulic pump 2 and draws pressure fluid out of the pressure fluid tank, via the feed filter 18, and feeds this pressure fluid into the feed line 30. The feed line 30 is connected with the working lines 3 and 4 via check and pressure regulation valves 31 and 32, in order to feed the pressure fluid into the respective working line 3 or 4 carrying the lower pressure. By this means it is ensured that in the working circuit 3, 4 pressure fluid is available in sufficient quantity as working medium. For avoiding an over-pressure in the feed line 30, there is further provided an over-pressure valve 33 which connects the feed line 30 with the pressure fluid tank 17.

The control of the working hydraulic pump 2 is effected in the exemplary embodiment manually by the operator via the hand controller 5, which is connected with a control pressure in-feed 35 via a control line filter 34. In dependence upon the intended direction of rotation of the rotating mechanism, the hand controller 5 delivers a control pressure into one of the two control lines 6 or 7, the height of which pressure is proportional to the intended torque. The respective other control line in each case, 7 or 6, is vented via the tank line 36.

The control lines 6 and 7 are led to the pre-control chambers 39 and 40 of the pre-control arrangement 8, via throttle points 37 and 38. The pressure difference between the pre-control chambers 39 and 40 effects a displacement of the valve body 41 of the pre-control arrangement 8 into one of the two control positions 42 or 43, depending upon which of the control lines 6 or 7 is acted upon with the control pressure.

In the control positions 42 or 43 of the pre-control arrangement 8, one of the setting pressure chambers 10 or 11 is acted upon with a setting pressure, whilst the respective other setting pressure chamber 11 or 10 is connected with the pressure fluid tank 17 via the tank line 44 and the brake valve 45 to be described in more detail.

The consequential displacement of the setting piston 12 brings about a swinging out of the working hydraulic pump 2 in the desired direction of delivery, so that the drive hydraulic motor (not shown), and the rotating mechanism driven thereby, is accelerated in the intended direction of rotation. For the mechanical return arrangement 46, a return force proportional to the displacement of the setting piston 12 out of its neutral position is exercised on the pre-control arrangement 8, where this is known in principle from DE-OS 41 25 706. Further, there are provided compensation lines 47 and 48 connected with the working lines 3 and 4, so that the pressure difference arising between the working lines 3 and 4 acts in a force compensating manner on the displacement of the valve body 41 of the pre-control arrangement 8.

A pressure cut-off valve 50 is arranged between a change-over valve 49, connected with the control pressure lines 6 and 7, and the pressure fluid tank 17. The pressure cut-off valve 50 effects a pressure limitation of the control pressure prevailing in the respective pressure-carrying control pressure line 6 or 7, whereby the maximum pressure can be predetermined via an electromagnetic setter 51.

Further, a brake valve 45 is provided which makes possible a controlled and sensitive braking. The brake valve 45 is arranged between the tank line 44, connected with the precontrol arrangement 8, and the pressure fluid tank 17. The brake valve 45 is on the one hand acted upon by the control pressure prevailing in the control lines 6 and 7, via the control pressure connection line 52 and the change-over valve 49, and is acted upon on the other hand by the working pressure prevailing in the working line 3 or 4 on the high pressure side, via the working pressure connection line 53 and the change-over valve 54. When the hand controller 5 is returned into its neutral position, and thus the control pressure in the control pressure lines 6 and 7 falls, but a working pressure is still present in the high pressure side working line 3 or 4, the brake valve 45 is displaced into its throttled valve position 55, so that the corresponding setting pressure chamber 10 or 11 is vented to the pressure fluid tank 17 only with delay and thus the braking procedure is delayed.

Corresponding to the further development in accordance with the invention, the setting pressure is not obtained directly from the setting pressure lines 6 and 7, but indirectly via a pressure limiting valve 56 from the feed pressure prevailing in the feed line 30. For this purpose, the pre-control arrangement 8 is connected with the feed line 30 via a setting pressure line 57, the pressure regulation valve 56 and the throttle point 58. The pressure regulation valve 56 thereby regulates the setting pressure prevailing in the setting pressure line to a pressure level which is provided from the force equilibrium between on the one hand the control pressure of the pressure-carrying control pressure line 6 or 7, delivered via the control pressure connection line 52 and the change-over valve 49, and the spring action by means of the pressure spring 59 and, on the other hand, the setting pressure delivered via the by-pass line 60. Thereby, a setting pressure arises in the setting pressure line 57 which, due to the spring action by means of the pressure spring 59, is slightly higher than the control pressure prevailing in the pressure-carrying control pressure line 6 or 7. The pressure difference between the setting pressure and the control pressure is preferably 1 to 2 bar and can be set via the adjustable pressure spring 59.

When the hand controller 5 is returned into its neutral position, in which there thus prevails no control pressure in the control pressure lines 6 and 7 and thus the valve body 41 of the pre-control arrangement 8 is returned into its neutral position 61, the setting pressure chambers 10 and 11 of the adjustment arrangement 9 are connected via the pressure regulation valve 56 with the feed line 30. By means of the pressure spring 59 it is ensured that the pressure fluid can flow back, via the setting pressure line 57 and the pre-control arrangement 8, into the setting pressure chambers 10 and 11, when the setting piston 12 is returned into its neutral middle position due to the return springs 13 and 14. The pressure fluid necessary for the volume equalization in the setting pressure chambers 10 and 11 is thus, corresponding to the development in accordance with the invention, not drawn in via an after-suction arrangement from the pressure fluid tank 17, but is delivered via the pressure regulation valve 56 out of the feed line 30. Since the pressure fluid in the feed line 30 is filtered by the feed filter 18 and is largely free from dirt particles, a contamination of the pre-control arrangement 8 and the setting pressure chambers 10 and 11 during the return procedure is reliably avoided, particularly in that the connection to the tank line 44 is broken in the neutral position 61 of the pre-control arrangement 8. By means of the pressure spring 59 it is ensured that also after fall of the setting pressure in the setting pressure lines 6 and 7 to zero, a slight pressure of preferably 1 to 2 bar is maintained in the setting pressure line 57, which is sufficient for the after-flow of the pressure fluid into the setting pressure chambers 10 and 11 during the return procedure.

By means of the development in accordance with the invention it is ensured that always filtered oil from the feed line 30 is delivered to the pre-control arrangement 8 and the adjustment arrangement 9. Thereby, a contamination of these arrangements is reliably avoided. Further, an after-suction arrangement having a relatively large after-suction filter can be omitted, so that the hydraulic controller in accordance with the invention can be configured constructionally more compactly. Further, the adjustment arrangement is continuously supplied with oil.

A further substantial advantage is provided by the fact that the setting pressure is derived from the feed pressure. As a consequence of a disruption of operation in the feed arrangement 19, in particular due to blockage of the feed valve 18, it can occur that the leakage losses in the working circuit 3, 4 can no longer be compensated by means of the feed arrangement 19. In order to avoid damage to the working hydraulic pump and the working hydraulic motor, it is absolutely necessary in this fault condition to swing back at least the working hydraulic pump 2 to zero displacement volume. This is automatically achieved by means of the development in accordance with the invention, since with a fall of the feed pressure in the feed line 30 there is linked simultaneously a fall of the setting pressure in the setting pressure line 57, so that the working hydraulic pump can no longer be swung out by the adjustment arrangement 9.

Figure 3:
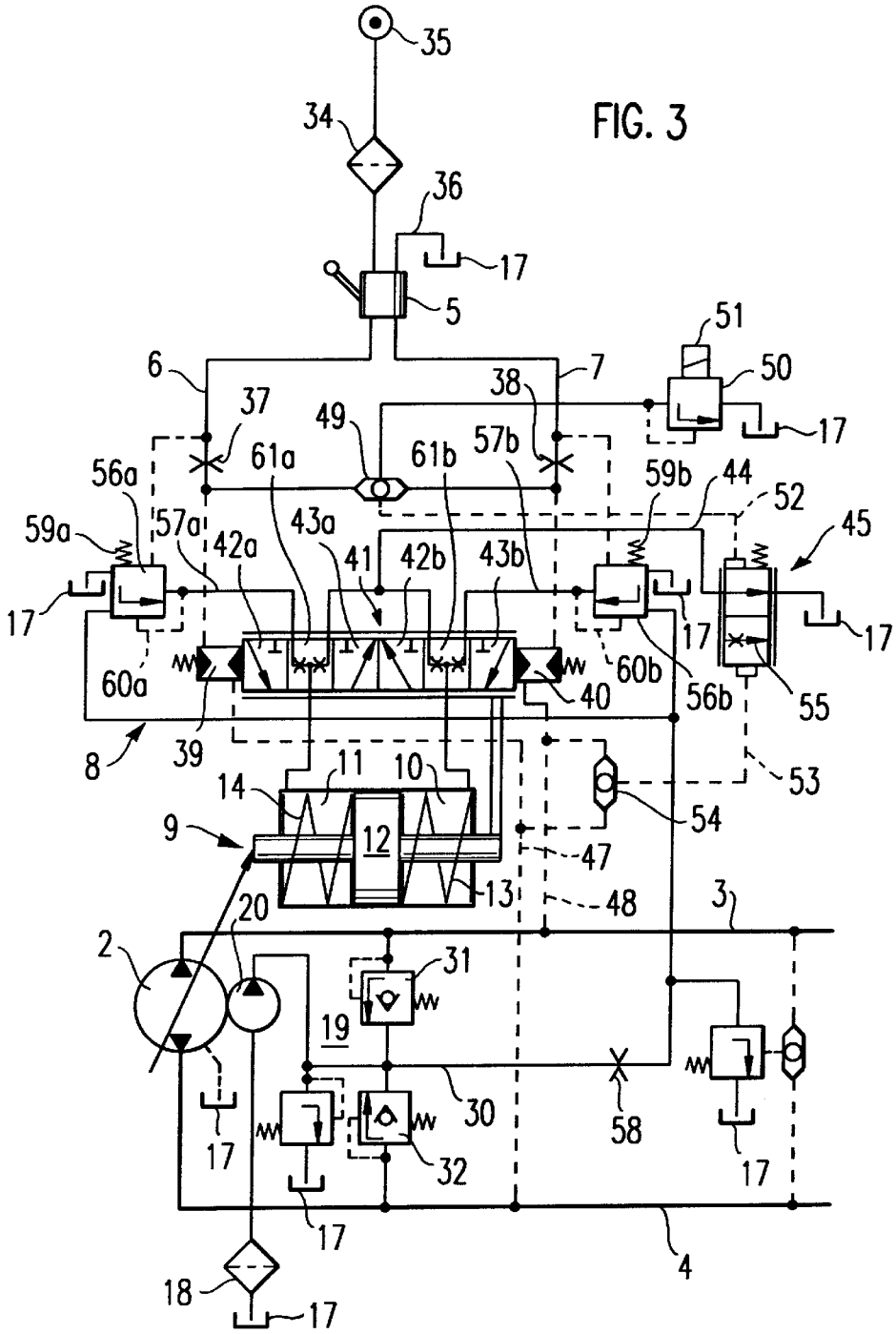
FIG. 3 shows a second exemplary embodiment of the hydraulic controller in accordance with the invention.

FIG. 3 shows a further exemplary embodiment of the invention with an additional development. The elements already described with reference to FIG. 1 are provided with corresponding reference signs, so that with regard thereto a repeated description is not necessary.

In contrast to the exemplary embodiment according to FIG. 1, with the exemplary embodiment according to FIG. 3 the control for the right and left slewing of the rotating mechanism is separately constituted. For this purpose, the valve body 41 of the pre-control arrangement 8 has separate valve regions 42*a*, 61*a*, 43*a* and 42*b*, 61*b* and 43*b*. A valve region 42*a*, 61*a*, 43*a* having the control positions 42*a* and 43*a* and the neutral position 61*a*, serves for control of the setting pressure chamber 11. In contrast, the valve region 42*b*, 61*b*, 43*b*, having control positions 42*b* and 43*b* and the neutral position 61*b*, serves for control of the control pressure chamber 10. The two valve regions are accommodated in a unitary valve body 41. The functioning of this 6/3-way valve is largely the same as that of the 4/3-way valve which finds employment in the exemplary embodiment according to FIG. 1.

For each valve region of the pre-control arrangement 8 there is provided a separate pressure regulation valve 56*a* and 56*b*, which are both connected with the feed line 30 via the throttle point 58. By means of the pressure regulation valve 56*a*, the pressure in the setting pressure line 57*a* is regulated substantially to the control pressure predetermined by means of control line 6, whereby the pressure in the control pressure line 57*a* is slightly larger than the control pressure in the control line 6 due to the pressure spring 59*a*. The same applies to the pressure regulation valve 56*b*, whereby the setting pressure in the setting pressure line 57*b* is regulated substantially to the control pressure prevailing in the control line 7, but is slightly greater than the control pressure prevailing in the control line 7 due to the pressure spring 59*b*.

Figure 2:
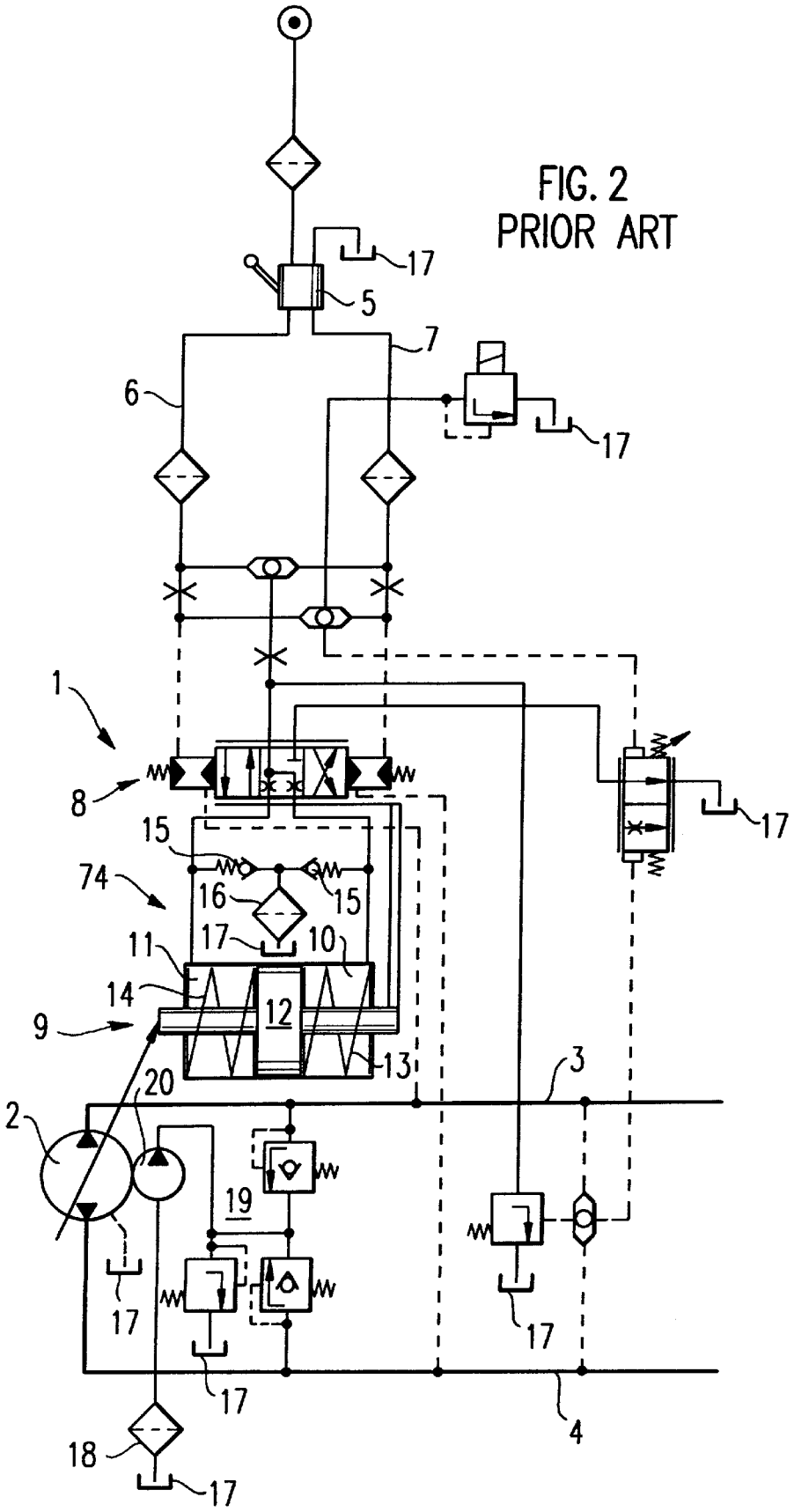
FIG. 2 PRIOR ART
FIG. 2 shows a hydraulic controller corresponding to the state of the art.

The separation of the control for right and left slewing has the advantage that in the case of a blockage of the pre-control arrangement 8 as a consequence of the penetration of dirt particles, no dangerous fault condition appears. Whilst with the exemplary embodiment according to FIG. 1, in the same manner as also with the state of the art reproduced in FIG. 2, upon a blockage of the pre-control arrangement 8 in one of its control positions 42 or 43, and a subsequent change of the pressure side in the control lines 7 and 6, a further slewing of the rotating mechanism is caused, without the intended change of direction of rotation, this fault condition is avoided with the exemplary embodiment according to FIG. 3. When, with the exemplary embodiment according to FIG. 3, the pre-control arrangement 8 is blocked on one of its control positions, e.g. in the control position 42*a* and 42*b*, this means that the setting pressure chamber 11 is connected with the feed line 30 via the pressure regulation valve 56*a* and the setting pressure chamber 10 is connected with the pressure fluid tank 17 via the tank line 44. If now, as a consequence of an intended change of direction of rotation of the controlled rotating mechanism, the control line 7, instead of the control line 6, is acted upon with control pressure by means of the hand controller 5, this brings about no more swinging-out of the drive hydraulic pump 2, since the connection with the setting pressure line 57*b* is cut off due to the blocking of the pre-control arrangement 8 in the control position 42*b*. The setting pressure chamber 10 is thereafter, in this fault condition, not acted upon with setting pressure. Differently than with the exemplary embodiment according to FIG. 1, however, the setting pressure chamber 11 is not acted upon in unintended manner with setting pressure, since the setting pressure chamber 11 is connected with the setting pressure line 57*a* via the pre-control arrangement 8 blocked in the control position 42*a*. The setting pressure line 57*a* is, however, substantially pressureless since the setting pressure prevailing in the setting pressure line 57*a* is predetermined via the pressure regulation valve 56*a* by the control pressure prevailing in the control line 6. Since, after reversal of the intended direction of rotation, the control line 6 is pressureless, no defective swinging-out of the drive hydraulic pump 2 in the non-intended original direction of delivery occurs. Thus, an acceleration of the rotating mechanism in the non-intended direction of rotation is effectively prevented.

With regard to the replacement, in accordance with the invention, of the after-suction arrangement by an oil feed from the feed line 30, controlled via the pressure regulation valves 56*a* and 56*b*, reference can be made to the advantages indicated above.

Figure 4:
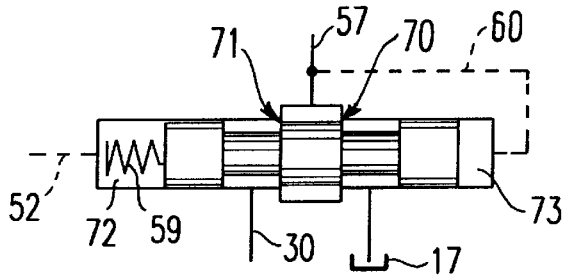
FIG. 4 shows, in schematic representation, a pressure regulation valve employed with the hydraulic controller in accordance with the invention.

FIG. 4 shows an exemplary embodiment of a pressure regulation valve 56, 56*a* and 56*b* employed within the scope of the present invention.

The setting pressure line 56 is connected via a first control edge 70 with the pressure fluid tank 17 and via a second control edge 71 with the feed line 30. A first pressure chamber 72 is connected via the control pressure connection line 52 with one of the control lines 6 or 7, whilst a second pressure chamber 73 is connected with the setting pressure line 57 via a by-pass line 60. Further, there is provided in the first pressure chamber 72 a preferably adjustable pressure spring 59. Through the balance of forces which arises, the pressure in the setting pressure line 57 is set to a slightly higher pressure than the control pressure prevailing in the control pressure connection line 52. The difference between the setting pressure prevailing in the setting pressure line 57 and the control pressure predetermined via the control pressure connection line 52 corresponds to the additional force caused by means of the pressure spring 59. The pressure difference between the setting pressure and the control pressure is preferably 1 to 2 bar.

The invention is not restricted to the illustrated exemplary embodiments. In particular, the concrete configurations of the pre-control arrangement and of the adjustment arrangement can, within the scope of the present invention, be differently provided. As a pressure regulation valve 56, 56*a* and 56*b* there can be employed known pressure regulation valves of any construction.

What is claimed is:

1. Hydraulic controller for the control of a rotating mechanism of an excavator comprising:

a hydraulic drive circuit (2, 3, 4) with a drive hydraulic pump (2) and a drive hydraulic motor, and two working lines (3, 4) connecting the drive hydraulic pump (2) and the drive hydraulic motor, a feed arrangement (19) for feeding pressure fluid into the drive circuit (2, 3, 4), an adjustment arrangement (9) for adjusting a setting piston (12) arranged between two setting pressure chambers (10, 11) and acting upon the displacement volume of the drive hydraulic pump (2), a pre-control arrangement (8) which acts upon the setting pressure chambers (10, 11) with a setting pressure in dependence upon the pressure difference between two control lines (6, 7), and said pre-control arrangement (8) including a pressure regulation valve (56) which is connected with the feed arrangement (129), the pre-control arrangement (8) when in a control position (542, 43), connecting one of the two setting pressure chambers (10; 11) with the feed arrangement (19) via the pressure regulation valve (56) and connecting the respective other setting pressure chamber (11; 10) with a pressure fluid tank (17) and, when in a neutral position (41), connecting both setting pressure chambers (10, 11) with the feed arrangement (19) via the pressure regulation valve (560, and wherein the pressure regulation valve (56) sets the setting pressure to a pressure which is at least slightly higher than the control pressure prevailing in the control line (6, 7) having a higher pressure.

2. Hydraulic controller according to claim 1, wherein the pre-control arrangement (8) includes a 4/3-way valve.

3. Hydraulic controller according to claim 1, wherein the feed arrangement (19) includes a feed pump (20) which is connected with the working lines (3, 4) via check valves (31, 32).

4. Hydraulic controller according to claim 1, wherein a pressure cut-off valve (50) is provided between the control lines (6, 7) and the pressure fluid tank (17), said pressure cut-off valve limiting the pressure in the control lines (6, 7) to a predetermined maximum pressure.

5. Hydraulic controller according to any one of claims 1 to 4, wherein a brake valve (45) is provided between the pre-control arrangement (8) and the pressure fluid tank (17), said brake valve throttling the connection between the setting pressure chambers (10, 11) and the pressure fluid tank (17) in dependence upon the pressure difference between the control pressure line (6, 7) having a higher pressure and the working line (3, 4) having a higher pressure.

6. Hydraulic controller for the control of a rotating mechanism of an excavator, comprising:

a hydraulic drive circuit (2, 3, 4) with a drive hydraulic pump (2) and a drive hydraulic motor, and two working lines (3, 4) connecting the drive hydraulic pump (2) and the drive hydraulic motor, a feed arrangement (19) for feeding pressure fluid into the drive circuit (2, 3, 4), an adjustment arrangement (9) for adjusting a setting piston (12) arranged between two setting pressure chambers (10, 11) and acting upon the displacement volume of the drive hydraulic pump (2), a pre-control arrangement (8) which acts upon the setting pressure chambers (10, 11) with a setting pressure in dependence upon the pressure difference between two control lines (6, 7), and the pre-control arrangement (8) including two pressure regulation valves (56*a*, 56*b*), which are connected with the feed arrangement (19), the pre-control arrangement (8) has two separate valve regions (42*a*, 61*a*, 43*a*; 42*b*, 61*b*, 43*b*) each for connecting one of the two setting pressure chambers (10, 11) with one of the two pressure regulation valves (56*a*, 56*b*), whereby the pre-control arrangement (8), in a control position (42, 43), connects one of the two setting pressure chambers (10; 11) with the feed arrangement (19) and connects the respective other setting pressure chambers (11; 10) with a pressure fluid tank (17) and, in a neutral position (41), connects both setting pressure chambers (10, 11) with the feed arrangement(19).

7. Hydraulic controller according to claim 6, wherein the pre-control arrangement (8) includes a 6/3-way valve.

8. Hydraulic controller according to claim 6, wherein the feed arrangement (19) has a feed pump (20) which is connected with the working lines (3, 4) via check valves (31, 32).

9. Hydraulic controller according to claim 6, wherein the pressure regulation valves (56*a*, 56*b*) set the setting pressure based on the control pressure prevailing in the control line (6, 7) having a higher pressure.

10. Hydraulic controller according to claim 6, wherein the pressure regulation valves (56*a*, 56*b*) set the setting pressure to a pressure which is slightly higher than the control pressure prevailing in the control line (6, 7) having a higher pressure.

11. Hydraulic controller according to claim 6, wherein a pressure cut-off valve (50) is provided between the control lines (6, 7) and the pressure fluid tank (17), which pressure cut-off valve limits the pressure in the control lines (6, 7) to a predetermined maximum pressure.

12. Hydraulic controller according to claims 6 to 11, wherein a brake valve (45) is provided between the precontrol arrangement (8) and the pressure fluid tank (17), which brake vale throttles the connection between the setting pressure chambers (10, 110 and the pressure fluid tank (17) in dependence upon the pressure difference between the control pressure line (6, 7) having a higher pressure and the working line (3, 4) having a higher pressure.

* * * * *